US011028514B2

(12) United States Patent
Clara et al.

(10) Patent No.: US 11,028,514 B2
(45) Date of Patent: Jun. 8, 2021

(54) METHOD TO CONTROL A WASHING MACHINE AND A WASHING MACHINE

(71) Applicant: Electrolux Appliances Aktiebolag, Stockholm (SE)

(72) Inventors: Marco Clara, Porcia (IT); Andrea Mazzon, Porcia (IT); Elena Pesavento, Porcia (IT); Elisa Stabon, Porcia (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 284 days.

(21) Appl. No.: 16/098,562

(22) PCT Filed: Apr. 12, 2017

(86) PCT No.: PCT/EP2017/058878
§ 371 (c)(1),
(2) Date: Nov. 2, 2018

(87) PCT Pub. No.: WO2017/190932
PCT Pub. Date: Nov. 9, 2017

(65) Prior Publication Data

US 2019/0352834 A1 Nov. 21, 2019

(30) Foreign Application Priority Data

May 6, 2016 (EP) ..... 16168539

(51) Int. Cl.
*D06F 34/18* (2020.01)
*D06F 34/28* (2020.01)
(Continued)

(52) U.S. Cl.
CPC ..... *D06F 34/18* (2020.02); *D06F 33/00* (2013.01); *D06F 34/28* (2020.02); *D06F 39/088* (2013.01);
(Continued)

(58) Field of Classification Search
CPC .... D06F 18/00; D06F 33/00; D06F 33/30–76; D06F 34/00–34;
(Continued)

(56) References Cited

U.S. PATENT DOCUMENTS 6,760,942 B2 * 7/2004 Lee ..... D06F 35/006 8/159
2008/0250573 A1 10/2008 Lee
(Continued)

FOREIGN PATENT DOCUMENTS

CN 103025946 A 4/2013
CN 104088113 A 10/2014
WO 2005118936 A1 12/2005

OTHER PUBLICATIONS

Chinese Office Action issued in Chinese Application No. 201780025479.6, dated Jul. 3, 2020, with translation, 23 pages.
(Continued)

*Primary Examiner* — David G Cormier
(74) *Attorney, Agent, or Firm* — RatnerPrestia

(57) ABSTRACT

A method to control a washing machine including a tub and a drum rotatably mounted inside the tub. The method includes and configured to contain laundry to be washed, the method comprising setting a wash cycle, calculating a first duration of the washing cycle based on a weight of the laundry before adding water to the tub, and: (i) when the weight is above the threshold, introducing water into the tub, calculating a second weight of the laundry, calculating a second duration based on the second weight, or (ii) when the weight is below the threshold, updating the first duration while executing the washing cycle, without calculating a second duration.

15 Claims, 4 Drawing Sheets

(51) Int. Cl.
*D06F 39/08* (2006.01)
*D06F 33/00* (2020.01)

(52) U.S. Cl.
CPC .... *D06F 2202/085* (2013.01); *D06F 2202/10* (2013.01); *D06F 2204/086* (2013.01); *D06F 2204/10* (2013.01); *D06F 2216/00* (2013.01); *D06F 2220/00* (2013.01)

(58) Field of Classification Search
CPC ..... D06F 35/008; D06F 37/42; D06F 39/00; D06F 39/006; D06F 39/088; D06F 58/00; D06F 58/02; D06F 58/30; D06F 58/32–52; D06F 58/203; D06F 2101/00–20; D06F 2103/00–70; D06F 2105/00–62; D06F 2201/085; D06F 2201/10; D06F 2202/00–12; D06F 2204/00–10; D06F 2206/00; D06F 2210/00; D06F 2212/00–06; D06F 2214/00; D06F 2216/00; D06F 2220/00; D06F 2222/00; D06F 2224/00; D06F 2226/00
See application file for complete search history.

(56) References Cited

U.S. PATENT DOCUMENTS

2012/0005840 A1 1/2012 Jang et al.
2012/0312055 A1 12/2012 Fagstad et al.

OTHER PUBLICATIONS

International Search Report and Written Opinion for International Application No. PCT/EP2017/058878, dated Jun. 12, 2017—8 pages.

* cited by examiner

METHOD TO CONTROL A WASHING MACHINE AND A WASHING MACHINE

This application is a U.S. National Phase application of PCT International Application No. PCT/EP2017/058878, filed Apr. 12, 2017, which claims the benefit of EP 16168539.1, filed May 6, 2016, both of which are incorporated by reference herein.

The present invention relates to a method to control a washing machine and to a washing machine.

Commonly, a washing machine includes a tub where water is introduced, a drum which is rotatably mounted inside the tub to receive laundry, such as clothes, shoes, accessories etc., and a motor which generates a drive force to rotate the drum, thereby allowing washing to be performed via tumbling of laundry in the drum. For example, the laundry is tumbled along an inner wall of the drum during rotation of the drum.

Further, in such washing machines, a plurality of washing programs or washing cycles are generally available. Commonly, washing programs or cycles include a washing step to eliminate stains on laundry using water and preferably also a detergent, and a rinsing step to rinse the laundry.

The duration of a washing cycle can be very different from one cycle to the others. Commonly, a cotton cycle is relatively very long, while an "express" cycle is relatively short. Users prefer to have an idea of the duration of the cycle, for example to plan when to remove the laundry from the washing machine.

It is known that the duration of the washing of the laundry may depend on the weight of the same. That is, in order to have a proper washing of the laundry, its overall weight is preferably taken into account. However, to adapt all washing cycles so that their default duration is equal to the longest possible, is not feasible because it implies a waste of resources, such water and energy.

There is therefore a need for a method to control a washing machine, and a washing cycle in which the duration of the washing cycle is determined taking into account the weight of the laundry in an easy and reliable manner, without affecting excessively the cost of the appliance.

According to a first aspect, the invention relates to a method to control a washing machine, the washing machine including a tub and a drum, the drum being rotatably mounted inside the tub and apt to contain laundry to be washed, the method comprising:

- setting a washing cycle among a plurality of washing cycles;
- calculating a first weight of the laundry in the drum before water is supplied to the drum and/or tub;
- comparing the first weight to a first threshold;
- calculating a first duration of the set washing cycle on the basis of said first weight;
- displaying said first duration;
- if said first weight is above the first threshold, then the method further includes:
  - introducing water into the tub;
  - calculating a second weight of the laundry present into the drum;
  - calculating a second duration of the set washing cycle on the basis of said second weight;
  - displaying said second duration;
- and, if said first weight is below or equal to the first threshold, then the method further includes:
  - gradually updating said first duration while executing said washing cycle, without calculating the second duration.

In the present context, a washing machine may indicate a "simple" washing machine where the washing of laundry is performed, or a combined washer dryer, where, in addition to the washing, drying of the laundry is performed.

The washing machine includes a drum where laundry is located, which can rotate around an axis by means of a motor. The axis of rotation of the drum can be horizontal, that is, substantially parallel to a surface where the appliance is located or slightly tilted to it, or vertical. Therefore, the washing machine might be a front loading washing machine or a top loading washing machine as well.

The washing machine further preferably comprises a casing, preferably but not necessarily parallelepiped-shaped, on which a door is advantageously hinged to access and close the drum in order to load or unload the laundry to be washed. The door is preferably hinged on a front wall of the casing in case of a front loading washing machine, while it is hinged on a top wall of the casing in case of a top loading washing machine.

Further, the washing machine is connected to a water supply, for example to the water mains, by means of suitable pipes which can be opened or closed, for example by a valve, in order to introduce water to the drum. One or more discharge pipes can be present as well in order to discharge water from the drum.

A drawer or other container is also preferably present and fluidly connected to the drum in order to introduce detergent into the drum itself, if needed during the laundry washing.

The washing machine may further include a control panel, for example located in an upper portion of the casing, where inputs or commands can be selected by an user, and/or information about the status of the washing machine can be displayed, for example by means of a display or one or more light indicators.

In operation, a washing machine include a plurality of washing programs or cycles. Each washing program preferably includes a washing step where the laundry is washed, such as tumbled, and a rinsing step, where the laundry is rinsed. The washing program may also include a spinning step where the drum is rotated at relatively high velocity. Further steps may be present as well, for example a pre-washing or others.

The various cycles may differ one from the others for the duration of the same, for the number or rinsing steps, for the temperature of the washing water, for the amount of detergent and so on.

The washing programs are preferably designed to treat laundry made of a specific textile type or composition or type of dirt or stain. For example, in a washing machine, a cotton cycle program at high temperature is generally present, as well as a delicate cycle program for delicate textiles (e.g. silk) at lower temperatures.

According to the invention, a washing program or cycle is set. The washing program or cycle is generally set either by a user operating on the control panel, for example by means of a switch, button, knobs and the like, or automatically, that is, a predefined washing program is stored on a memory of the washing machine and automatically selected when the appliance is switched on. Alternatively, the washing machine may "auto-select" the washing program among the available ones, for example all stored in a memory, depending on one or more characteristics of the laundry inserted in the drum, which are automatically detected.

The setting of a washing cycle predefines one or more of a plurality of parameters, that is, given the washing program, for example the duration of the same may be defined, as well as the type and quantity of detergent to be used, the temperature of the water, the amount of water to be used in washing, the amount of water to be used in rinsing, the revolution per minute of the drum, the duration of the washing cycle and others.

According to the invention, before water is introduced inside the drum and/or tub to wash the laundry, for example before the beginning of the washing cycle which has been set, a calculation of a first weight of the laundry introduced into the drum is performed. Such calculation takes place in any known manner, by means of a weight sensor.

For example, the first weight sensor may be a mechanical sensor of the weight of the laundry, but it may also be a predictive algorithm calculating the first weight by statistical methods.

Preferably, the calculation of the first weight is relatively "rough", that is, with a relatively low precision, and performed in a rather fast manner.

A value of the duration of the set washing cycle, also called "time-to-end" of the set washing cycle, on the basis of said first weight is then calculated. This value can be equal or different to the value present in a memory of the washing machine and associated to the set washing cycle. Thus, the calculated duration can be equal or different to the default duration associated with the set washing cycle.

This calculated first duration is displayed to the display of the washing machine, so that the user has in a very short time a more accurate prediction of the duration of the set washing cycle.

This first weight is compared with a first threshold.

The first threshold is preferably comprised in a range between about from ⅕ to ⅗ of the maximum admissible laundry load. More preferably, it is of about 2 kg. The first threshold therefore may depend on the type of washing machine, because not all washing machines have the same maximum load. Commonly, washing machines having a maximum load of 5 kg, 8 kg or 4 kg are known for household uses.

The first threshold is used to discern between a "heavy load", that is, when the first weight is above the first threshold means that the laundry which is present inside the drum of the washing machine is "heavy", or a "light load", that is, when the first weight is below the first threshold then the laundry present inside the drum is "light".

Relatively light loads, that is, loads that are below the first threshold, are not a big concern to be washed. Generally, if the weight of the laundry is not very high, the laundry can be relatively easily washed in a "standard" washing program cycle. Indeed, a good washing quality is generally achieved for light loads.

However, high loads may affect the functioning of the washing machine and pre-set washing programs may not be ideal for the correct washing of the laundry, in particular when it comes to the duration of the same.

Therefore, according to the invention, only when the first weight is above the first threshold, a second weight of the laundry is calculated. This second weight is calculated after water has been introduced into the tub and/or drum. Dependently from the second weight, the duration of the washing cycle which has been set is again determined, obtaining a second duration. The second duration is calculated and it is chosen so as to optimize the set washing cycle when the load is "heavy", that is, when the weight of the laundry is high.

In this way, the set washing cycle is adapted to the needs of the high load cycles, for example making the cycle longer if the load is "heavy".

In this way, a more accurate "investigation" of the weight of the laundry is performed only when there is a hint from the first weight calculation that the weight is above the first threshold. If the weight is above such a first threshold, the weight is calculated again, for example preferably in a longer and/or more precise manner, and the result of this second calculation is used to determine the second of the washing cycle. Thus, before varying the first duration of the washing cycle, it is determined whether the load is really "heavy", so that extra energy is used only if needed.

This second calculation is performed only when needed and it is then visualized, so that the user is aware of the new duration. Again, the user is "bothered" with a change in the displayed information only when needed, that is, only when a change in the duration of the set washing cycle is necessary because the weight of the laundry is really "high" and the quality of the washing could be compromised using a different duration value.

The washing cycle of heavy loads is therefore optimized and a better quality is achieved.

Preferably, if said first weight is above the first threshold, then the method further includes, after displaying said second duration:

gradually updating said second duration while executing said washing cycle.

After the duration of the set washing cycle has been updated with the second duration, for example visualized in a display of the washing machine, then this second duration is constantly updated to display the remaining time before the set washing cycle ends. The update is performed preferably at a regular pace, for example every second or every few seconds. The calculated second duration is thus constantly decremented preferably of a given amount depending on the lapsed time from the previous update. The user is thus constantly informed of the remaining "waiting time" before the cycle is going to be ended.

Preferably, calculating a second duration of the set washing cycle on the basis of said second weight includes:

calculating a second duration of the set washing cycle on the basis of said second weight, independently from the first weight.

Preferably, the two weight calculations are totally independent one from the other, that is, in the second weight calculation the first weight calculation or first weight value is not taken into consideration. Thus errors or mistakes made in the first calculation are not propagating further.

Preferably, the method of the invention further includes, after setting the washing cycle:

Displaying a predefined set washing cycle duration based on stored information on the set washing cycle;

Updating said predefined set washing cycle duration with said first duration.

Each washing cycle is preferably defined by a plurality of parameters, called "default parameters" which are for example saved in a memory of the washing machine. Thus, a default duration is associated with the set washing cycle. When the washing cycle is set, preferably its default duration is immediately displayed, so that the user gets immediately an idea of the time the laundry machine will take to wash the laundry. The default value of the duration of the set washing cycle is constantly updated, preferably at a regular pace. However as soon as the first weight is calculated and the first duration based on the first weight is determined, a "jump" in the displayed value takes place, because the default duration (the remaining part of it) is updated as soon as the first weight calculation is performed to inform the user of a better estimate of the duration time.

Preferably, gradually updating said first or second duration includes:

Decrementing a value of said first or second cycle duration in a countdown manner.

The value displayed regarding the first or second duration is updated regularly of the same quantity as in a countdown.

More preferably, the method includes:

Displaying the countdown on a display.

A display is preferably located in the upper part of the casing of the washing machine so as to be well visible to the user.

Preferably, the method according to the invention includes:

Determining an amount of water to be loaded into the drum during the set washing cycle based on said first weight or based on said second weight.

The weight of the laundry may influence other parameters of the set washing cycle, not only its duration. For example, the amount of the laundry may change the default value of the amount of water to be introduced inside the drum to wash or rinse the laundry. Preferably, the value of the first or second weight may change the value of the amount of rinsing water used to rinse the clothes in the rinsing step of the washing cycle.

Preferably, if said first weight is below or equal to the first threshold, then the method further includes:

introducing in the drum a predetermined amount of water;

waiting a predetermined time interval; and stopping water introduction if after said predetermined time interval a water level variation within said predetermined interval is below or equal to a second threshold.

The quantity of water which is introduced in the drum is preferably dependent on the set washing cycle. After the water has been introduced into the drum, in an amount which implies that the water is in contact with the laundry, variations of the level of the water inside the drums are calculated. The water inside the drum changes its level with time due to the fact that the laundry absorbs at least part of the introduced water. Thus, the level of the water changes from its initial level to a lower level after a certain time period. If the variations of the level are "small", that is, if the difference between the initial water level and a level after a predetermined amount of time are below a given value called second threshold, then the water introduction is stopped. If however the variations are above such a second threshold, then the water is again introduced inside the drum and the level of the same is again monitored. If the variations of the level of the water remain below the above mentioned second threshold, then the water introduction is stopped, otherwise the cycle is again repeated. The variation of the water level is preferably calculated subtracting from the level of the water at the beginning of the pre-determined time interval, the water level at the end of the predetermined time interval.

Preferably, during the water level monitoring the drum remains still, that is, it does not rotate. However, in a different embodiment of the invention, in order to monitor the water level, the drum is rotated during water introduction. The drum is rotated so that the water may be better absorbed by the whole laundry present in the drum Preferably, if said first weight is above the first threshold, the method of the invention includes the steps of:

introducing water into the tub;

checking a level of water inside the drum;

calculating a second weight of the laundry present into the drum on the basis of the amount of water needed to maintain the level of water in the drum.

More preferably, if said first weight is above the first threshold, the method includes:

introducing in the drum a predetermined amount of water;

waiting a predetermined time interval;

stopping water introduction if after said predetermined time interval a water level variation within said predetermined time interval is below a third threshold;

calculating a second weight of the laundry present into the drum on the basis of the amount of water added in the drum up to the stopping of water introduction.

In order to calculate the second weight, preferably a predefined amount of water is introduced in the drum. This amount is predefined and preferably depends on the set washing cycle. After the water introduction, the water level in the drum is checked, it is waited for a given time interval and after this time interval has elapsed, the level of water in the drum is checked again. A variation of the water level can be thus calculated, subtracting from the initial water level the end water level. If the laundry has absorbed so much water that the variation of the water level is above a third threshold, more water is introduced, preferably again in a pre-defined amount, and the steps above are repeated, to check whether the water level variations are still "big", i.e. above goes below the third threshold limit level. The time interval is set so that generally the laundry has absorbed all the water it can absorb within it, so that the level of water into the drum cannot get lower of a pre-set value even if more time has elapsed. In this way, the second weight can be determined on the basis of the amount of water absorbed by the laundry. As above, the water level may be monitored with or without drum rotations.

Preferably, said washing machine includes a motor driving the drum in rotation and calculating a first weight of the laundry in the drum before water is supplied to the drum and/or tub includes:

calculating the first weight by detecting one or more parameters of the motor while the drum is rotating.

The drum is rotated by means of a motor, which may also control the drum velocity and the reversal of rotations, if needed. In order to calculate the first weight, which is calculated without the introduction of water into the drum, preferably parameters of the motor while it rotates the drum are calculated, for example sensed or detected by suitable sensor(s) which are commonly present in a washing machine for other purposes. One of these parameters can be for example the torque of the motor. However one or more of the following can be used as well:

Parameters indicative of the operating conditions of the motor driving the drum in rotation, such as a motor torque value and/or a power absorbed by the motor and/or a current absorbed by the motor;

Speed or acceleration of the drum or number of times in which the drum reverses its rotation direction;

Speed or acceleration of an agitator located in the drum to move the laundry located therein;

Humidity of the laundry and variations thereof;

Time from the beginning of the selected program and/or phase of the program which is taking place;

Parameters indicative of operating conditions of mechanical elements of the appliance, like the opening or closing of valves, the activations of alarms and so on;

Etc.

Preferably calculating a first weight of the laundry in the drum before water is supplied to the drum and/or tub includes:

sensing a plurality of parameters concerning operating conditions of the washing machine; and predicting a weight of the laundry present within the washing machine based on said plurality of parameters by means of a data-driven soft sensor.

The weight of the laundry in a laundry treatment appliance is a quantity that is either unmeasurable or costly/time-consuming to obtain. Therefore in the present invention a statistical model-based technology addressed to industrial environments that provide an estimate of such quantity is used. The primary purpose of sensors is to deliver data for process monitoring and control. In the context of process industry, predictive models are called Soft Sensors: term is a combination of the words "software", because the models are usually—but not necessarily—computer programs, and "sensors", because the models are delivering similar information as their hardware counterparts. Other common terms for predictive sensors in the process industry are inferential sensors, virtual sensor or on-line analyser and observer-based sensors.

Two different classes of Soft Sensors, namely model-driven and data-driven, can be distinguished.

Model-driven models are also called white-box models because they have full phenomenological knowledge about the process background. In contrast to this purely, data-driven models are called black-box techniques because the model itself has no knowledge about the process and is based on empirical observations of the process. In between the two extremes there are many combinations of these two major types of models possible. A typical example of such a combination is a model-driven Soft Sensor making use of data-driven method for the modelling of fractions which can not be modelled easily in terms of phenomenological models.

The present invention preferably uses a data driven model, being based on empirical data. Therefore a data-driven soft sensor is an inferential statistical model developed from process observations.

The soft sensor, which normally operates using a software, might be embedded in the control unit of the appliance. The same control unit—as already stated—preferably controls also the appliance during its functioning, that is, during the execution of the selected laundry program, for example sending command signals to the motor of the drum and to the other components participating in the correct functioning of the appliance. For example, in a heat pump dryer, the control unit sends command signals to the heat pump.

In this way, making use of values from sensors which are already available in the appliance for other purposes, and the same processor already used to control the proper functioning of the appliance, the weight of the laundry introduced inside the washing machine is predicted. This prediction is obtained by means of a statistical method by means of a soft sensor which is data driven. The operation of "training" the soft sensor is preferably performed in the production site. Without adding further elements (such as a new sensor) to the appliance, a prediction of the weight of the laundry is obtained.

Preferably, said step of predicting a weight of the laundry by means of a data driven soft sensor includes a step of predicting a weight of the laundry by means of a supervised learning prediction.

In supervised learning, from input data (in this case the values of the operating conditions of the appliance) are used to predict an output value (in this case the weight of the laundry).

In supervised learning, input data is called training data. A model is prepared through a training process where it is required to make predictions and is corrected when those predictions are wrong. The training process continues until the model achieves a desired level of accuracy on the training data. Preferably, the soft sensor of the invention uses a supervised learning method, that is a learning task of inferring a function from labelled training data. The training data consist of a set of training examples. In supervised learning, each example is a pair consisting of an input object (typically a vector) and a desired output value (also called the supervisory signal). A supervised learning algorithm analyses the training data and produces an inferred function, which can be used for mapping new examples.

In the present invention therefore, preferably the soft sensor uses the operating conditions of the appliance during the selected program and the output value includes the weight of the laundry present in the drum of the laundry treatment appliance. This is done after the algorithm had been properly trained by the training examples which are data collected in field tests of the appliance.

Preferably, the method according to the invention includes one or more:

Determining said first or second duration also on the basis of a characteristic of the set washing cycle;

Determining said first or second duration also on the basis of a hardness of introduced water in the washing;

Determining said first or second duration also based on an amount of dirt present in the laundry;

Determining said first or second duration also based on a colour of the laundry;

Determining said first or second duration also based on a fabric type of said laundry.

The first or second duration of the set washing cycle which is determined using the value of the first or second weight, respectively, may also depends on other characteristics or inputs of the washing machine. For example, if the type of laundry, that is, the type of textile forming the laundry or the main colour of the laundry such as "white" or "coloured" is inputted, the first or second duration to be determined depending on the first or second weight takes into account this additional information as well.

Preferably, said washing machine is a front loading washing machine.

Preferably, the step of calculating the first weight lasts less than 1 minute.

The first weight calculation, from its beginning to its end, that is, till the results is outputted, lasts less than a minute, for example about 30 seconds. Preferably, the first weight calculation is performed before the washing cycle starts. It is a relatively "fast calculation", where speed prevails preferably over accuracy.

Preferably, the step of calculating the second weight lasts less than 30 minutes.

The second weight calculation lasts generally longer than the first weight calculation, and it is also preferably more accurate. The second weight calculation has a duration which may also depends on the type of laundry, that is for example the longest duration calculated is for a cotton washing cycle.

Preferably, the method of the invention includes:

imputing a preferred duration of the set washing cycle;

determining a duration of the set washing cycle on the basis of the first or second weight and on the basis of the preferred inputted duration.

In an embodiment, the user may introduce some constraints to the set washing cycle, that is, it may determine the "wished value" of certain parameters of the set washing cycle. One of such parameters can be for example the duration of the washing cycle.

If the duration of the washing cycle as determined using the first or second weight is longer than what has been inputted by the user, then preferably the "wish duration" inputted overrules the calculated duration determined using the first or second weigh. If the duration of the washing cycle as determined using the first or second weight is shorter than what has been inputted by the user, then preferably the duration which has been calculated using the first or the second weight overrules what it has been inputted and it will be the real duration of the washing cycle. In other words, the real duration is preferably the shorter between the inputted and the calculated ones.

According to a second aspect, the invention relates to a washing machine including:

- a tub;
- a drum, the drum being rotatably mounted inside the tub and apt to contain laundry to be washed;
- a water inlet apt to introduce water into the tub and/or the drum;
- a first weigh sensor apt to calculate a first weight of the laundry;
- a second weight sensor apt to calculate a second weight of the laundry;
- a control panel;
- a memory storing information about one or more washing cycles;
- a control unit programmed for
  - receiving information about a set washing cycle;
  - obtaining a value of the first weight of the laundry from the first sensor before water is supplied to the drum and/or tub through said water inlet;
  - calculating a first duration of the set washing cycle on the basis of said first weight;
  - displaying said first duration;
  - comparing the first weight to a first threshold;
  - if said first weight is above the first threshold, then
    - obtaining the second weight of the laundry present into the drum from the second sensor after water has been introduced into the drum;
    - calculating a second duration of the set washing cycle on the basis of said second weight;
    - displaying said second duration;
  - and, if said first weight is below or equal to the first threshold, then the method further includes:
    - gradually updating said first duration while executing said washing cycle, without calculating the second duration.

The advantages of this invention have been already described with reference to the first aspect and they are not herein repeated.

Preferably said first weight sensor a soft sensor.

Preferably said first sensor includes a motor torque sensor.

The present invention will now be described with reference to the accompanying drawings that illustrate non-limiting embodiments thereof, wherein.

The following description refers to an advantageous embodiment of the invention in which the washing machine 1 is a "standard washing machine" with no drying functionality (i.e. a washing machine which can only wash and rinse the laundry).

However it is clear that the invention can be applied as well to washer—dryers (i.e. a washing machine which can also dry the laundry), not illustrated.

The washing machine 1 according to the invention which is schematically illustrated in the enclosed Figures is advantageously of the front-loading type; it is however clear that the invention is applicable, substantially without any crucial modification, to a top-loading washing machine.

Figure 1:
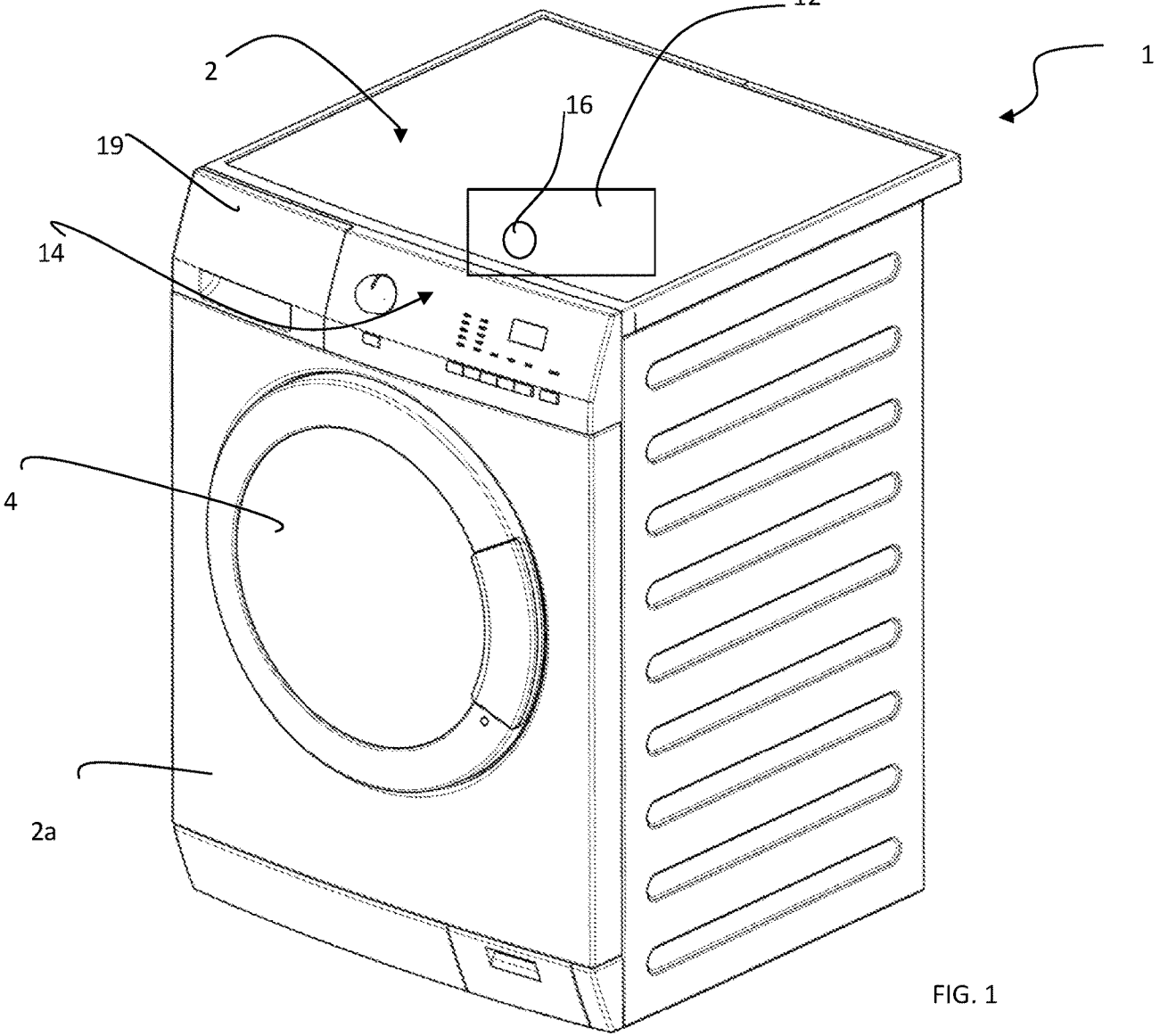
FIG. 1 is a isometric view of the washing machine of the invention.
Figure 2:
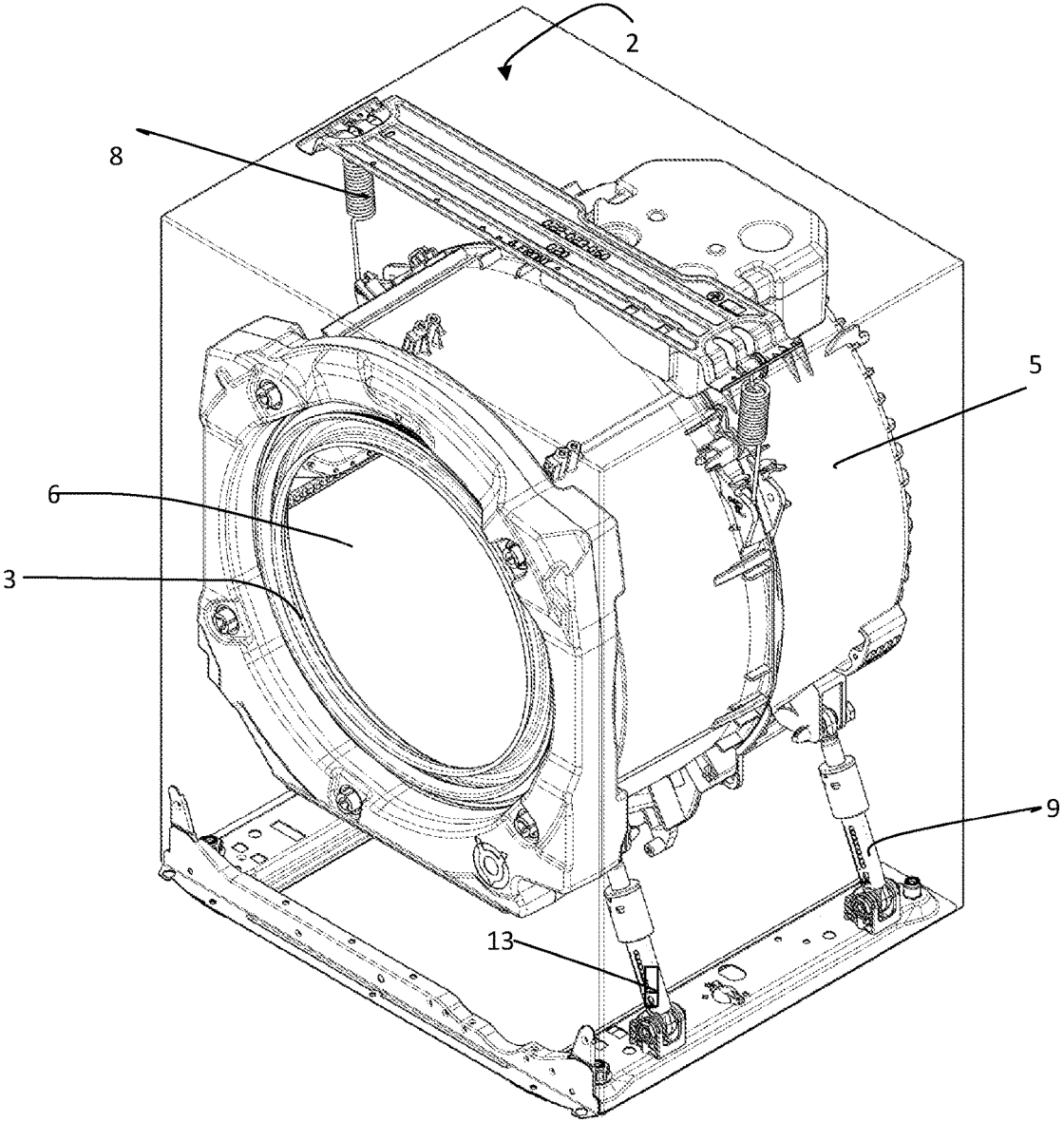
FIG. 2 is a further isometric view of the washing machine of FIG. 1 with the casing made transparent in order to show its inner components.
Figure 3:
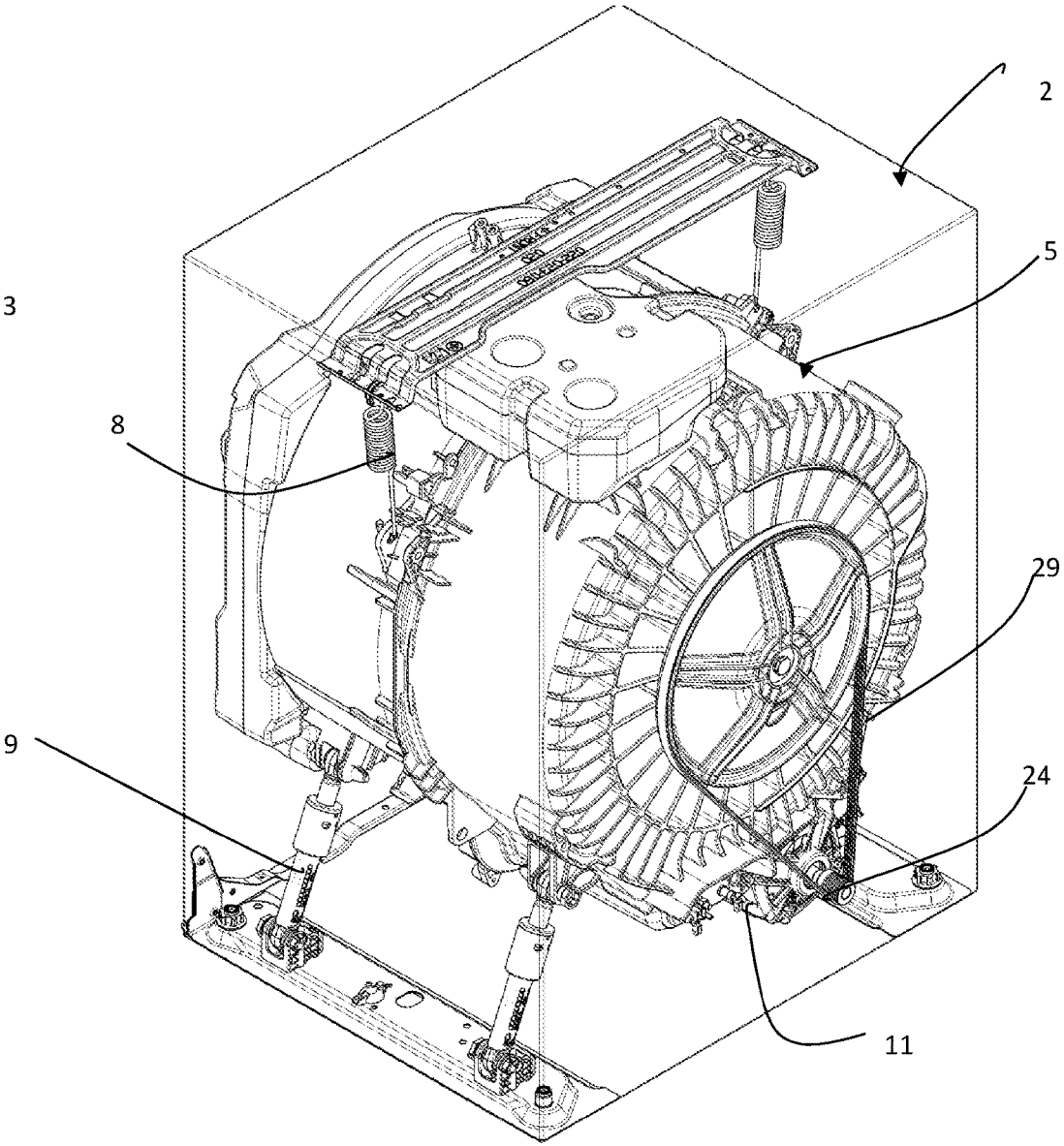
FIG. 3 is an isometric view of the washing machine of FIG. 2.

With reference to FIGS. 1 to 3, the washing machine 1 comprises an external casing 2 in which frontal wall 2*a* an access opening 3 is obtained, provided with a loading/unloading door 4, which allows the access to a washing tub 5 contained in the external casing 2; the washing tub 5 contains a rotatable perforated drum 6 in which the laundry to be washed, not depicted in the drawings, can be loaded and unloaded. In this advantageous embodiment the drum 6 embodies, therefore, a treating chamber in which one or more items (pieces of laundry in this advantageous embodiment) can be loaded and treated with water and one or more additives (washing/rinsing products in this advantageous embodiment). The rotational axis of the drum 6 is substantially horizontal.

The washing tub 5 is connected to the external casing 2 preferably via a flexible bellows, not represented, connected between the frontal, opened, surface of the washing tub 5 facing the access opening 3, and the border of the latter.

In the example illustrated, the washing tub 5 is advantageously elastically supported by the external casing 2 via a suitable resilient support system, comprising, for example, springs 8; preferably the oscillations of the washing tub 5 are damped by suitable shock-absorbing devices or dampers 9, interposed between the washing tub 5 and the bottom of the casing 2.

Clearly the washing tub 5 may be associated to the casing 2 in any other suitable way.

Advantageously, the washing machine 1 comprises a water inlet circuit, not visible in the figures, adapted for feeding water and washing/rinsing products, into the washing tub 5; the water inlet circuit comprises, for example, a removable drawer 19, adapted to be filled with washing and/or rinsing products, e.g. liquid or concentrate or gel detergent, or powder detergent, or softener, an inlet duct, also not represented, connectable to water delivery means present outside the washing machine 1 and adapted to deliver fresh water to the drawer 19, and an outlet duct, fluidly connecting the drawer 19 and the washing tub 5 and adapted to deliver water and washing/rinsing products into the washing tub 5.

The washing machine 1 also advantageously comprise a draining circuit, fluidly connected to the bottom of the washing tub 5 and adapted to drain the washing/rinsing liquid from the washing tub 5; in a further embodiment, not illustrated, the draining circuit may be also provided with a recirculation circuit, adapted to drain the washing/rinsing liquid from the bottom of the washing tub 5, and to re-admit such liquid into an upper region of the washing tub 5, for improving the wetting of the laundry.

Water inlet circuit and draining circuit are considered standard and known in the art and therefore not further discussed.

The washing machine 1 also comprises some electric and/or electronic components, adapted for performing some specific functions; for example the washing machine comprises an electric motor 11 for rotating the rotatable drum 6, a valve (not shown) adapted to deliver the washing/rinsing liquid into the washing tub 5, an electric pump (not shown) adapted to drain and/or to re-circulate the washing/rinsing liquid from the washing tub 5, an electric heater (also not shown) adapted to heat the washing/rinsing liquid, etc.

The drum 6 is advantageously rotated by the electric motor 11 which preferably transmits the rotating motion from a motor shaft 24 to the drum 6, advantageously by means of a belt/pulley system 29. In a different embodiment of the invention, the motor 11 can be directly associated with the shaft 24 of the drum 6.

The washing machine 1 advantageously comprises a logic unit (for example an electronic board, a microcontroller, a microprocessor, or any other similar electronic control unit/device), schematically indicated in FIG. 1 with the block numbered 12, configured to control the electric and/or electronic components of the washing machine 1, so as to make the washing machine 1 to perform a washing cycle, advantageously comprising one or more phases; for example the washing cycle may comprise a prewash phase, a soaking phase, a main washing phase (comprising, for example, the adduction into the washing tub 5 of water mixed with detergent and the rotation of the drum 6, so as to apply a mechanical action on the laundry), a steam supplying phase, a rinsing phase, a spinning phase, etc. The washing cycle may comprise one or more of the above mentioned phases (or also other phases well known in the art) adapted to apply to the laundry to be washed a specific chemical and/or physical action. A phase of the washing cycle may be performed, during a single washing cycle, only once or also two or more times. Clearly the duration of the overall washing cycle depends on the kind, on the number, and on the duration of its phases.

Each washing cycle is defined by a plurality of parameters, which are for example stored in a memory of the control unit 12. These parameters may include the duration of the cycle, the water temperature during the main washing phase, the number of rinsing phases, and so on. Thus, when a program among the plurality is set, a plurality of parameters is set as well.

The washing machine 1 is also provided with a first weight sensor, schematically represented in FIG. 1 with the block numbered 13, which is configured to detect/measure the weight of the laundry loaded in the rotatable drum 6. For example, the weight sensor 13 may comprise one or more transducers, operatively connected to the logic unit 12; the transducers may comprise, for example, a load cell or a strain gauge and can be associated with the resilient support system 8, 9 supporting the washing tub 5, as depicted in FIG. 2. More preferably, the first weight sensor 13 is a soft sensor measuring the weight of the laundry by means of an algorithm. Most preferably, it is part of the control unit 12.

However, it is underlined that the use of a particular first weight sensor 13 is not critical for the invention, and therefore substantially any device adapted to measure the weight of the laundry loaded into the rotatable drum 6 may be used. In all cases, the first weight sensor 13 is apt to measure a weight of the laundry when the laundry is in a dry state, that is, before water is introduced inside the drum 6.

The washing machine 1 comprises an user interface 14, which is operatively connected to the logic unit 12 and is configured to allow the user to manually set a washing cycle to be performed. Alternatively the washing cycle can be set automatically.

User interface 14 may comprise, for example, a touch screen display, adapted to display information and to receive inputs from the user, and or it may comprise a one or more buttons, and/or switches, and/or knobs, and/or displays, etc. allowing the user to receive information and to input instructions/commands directed to the logic unit 12.

The user, by means of the user interface 14, may program the washing machine 1 with one or more parameters indicating his/her "wish values" for them. That is, when the washing program or cycle is set, the user may change some of the pre-memorized values of these parameters by inputting its wished value from the user interface 14. These user's inputs overrule the standard memorized values for the parameters. Preferably, user interface is adapted to receive a "wish value" of the duration of the washing cycle from the user.

User interface 14 may be further configured to display user information; this information may comprise the name of a particular washing cycle, the weight of the loaded laundry, the duration of the washing cycle, the temperature of the washing/rinsing liquid, the rotating speed of the spinning, etc. More in general the user interface 14 is designed to present information related to the washing cycle and/or the status of the washing machine 1 and even more preferably it is designed to display the duration of the washing cycle.

In the embodiment illustrated in the enclosed Figures, the user interface 14 advantageously comprises a display device, preferably a LCD or a LED display, designed to present user information, and a separated input device, not illustrated, comprising for example a keyboard, and/or a set of keys or knobs, and/or one or more touch-sensitive input devices, etc., adapted for setting a washing cycle and washing-product information.

In another embodiment, not illustrated, the logic unit 12 may be advantageously integrated in the user interface 14.

Further, the washing machine includes a second weight sensor 16 apt to measure a weight of the laundry in the wet state. As for the first weight sensor, this second weight sensor 16 can be any as long as is apt to measure the weight of the laundry when it is wet. This second weight sensor 16 can also be a soft sensor, that is, an algorithm, and can be part of the logic unit 12, as depicted in FIG. 2.

Figure 4:
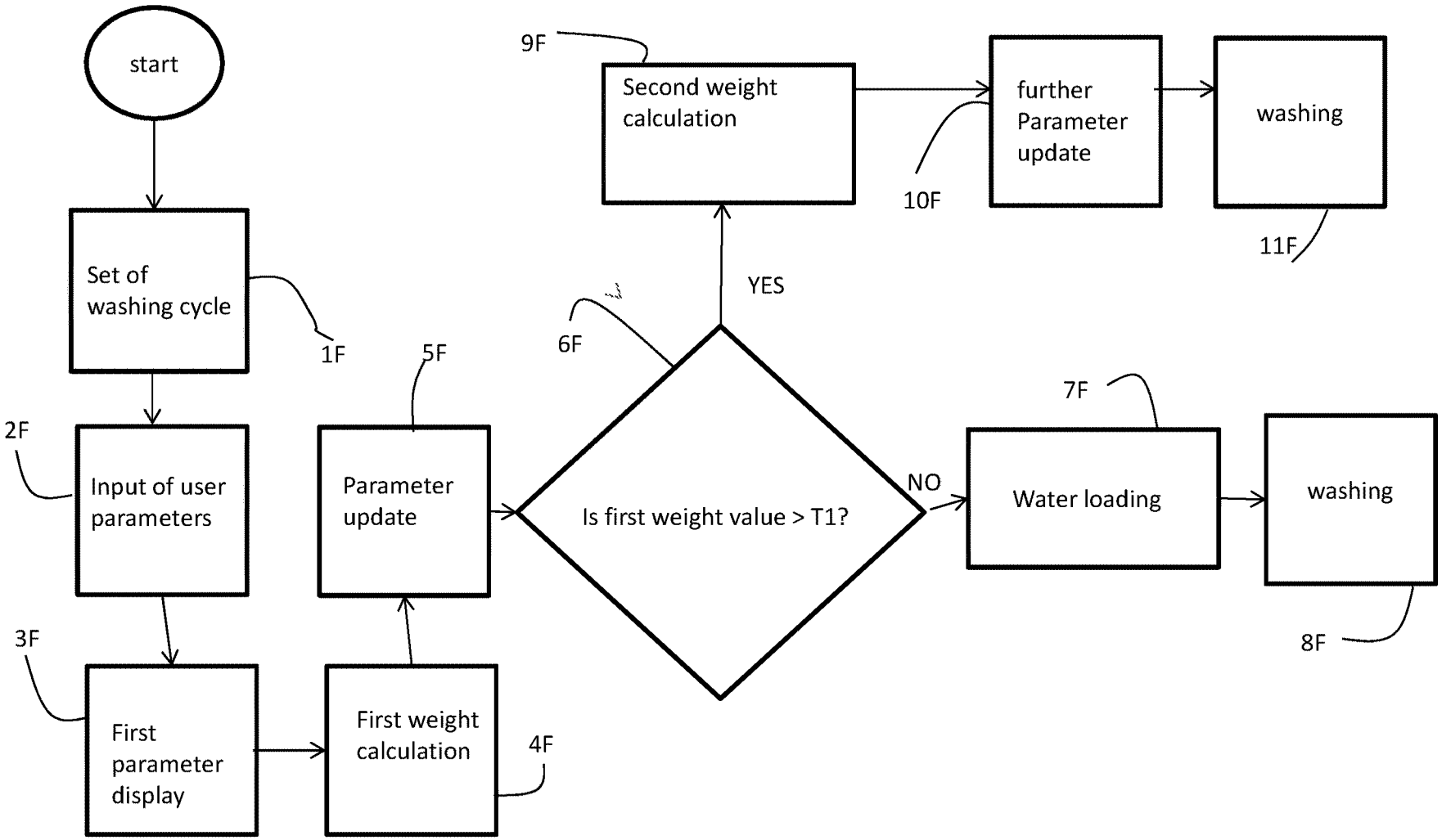
FIG. 4 is a flow chart of the various steps of the method of the invention.

A method of controlling the washing machine 1 will be described in more detail as follows, with reference to FIG. 4. First, a washing program or cycle among the stored plurality is set in the washing machine in step 1F. Such program or cycle may be inputted by the user. Given the set washing cycle, the default duration the same is set, the value of which may be changed according to the method of the invention. The user may also indicate a wish value for the duration of the washing cycle in step 2F. The input of the user therefore may change in step 2F the initially predetermined memorized values of the duration (the default duration) of the set washing cycle. Parameters relative to the set washing cycle may be displayed on the display of the control panel 14 in the step 3F, such as for example the duration of the set washing cycle. The value displayed is either the "default" value, that is, the value as stored in the memory, or the value of the parameter as modified by the user in step 2F. Preferably, from this moment for example the countdown of the visualized value begins so at any point in time the user is aware of the remaining duration of the washing cycle watching the display of the user interface 14.

Further, the first weight of laundry is detected, before the water is introduced into the drum, by means of the first weigh sensor 13 in step 4F. For example, the first weight value can be calculated driving the motor 11 to accelerate the drum 6 accommodating laundry to a certain speed and then measuring the torque and using a predictive algorithm.

The value of the first weight is used to calculate a first duration of the washing cycle. The default duration value which has been visualized in phase 3F needs to be modified by the new value calculated on the basis of the first weight, and thus the value on the display can be updated in phase 5F. The visualized value therefore may have a "sudden jump" from one value to the other, that is, for example from the pre-set memorized default duration that the set program cycle refers to in a memory of the washing machine, to a new value, the first duration, which is based on the first weight value.

Then, preferably still before water is admitted into the drum 6, it is checked whether the first weight value is above or below a given threshold T1 in phase 6F.

In case the first weight is below threshold T1, a "light" load is present in the drum 6 and no need for other weight calculation is present. The washing process begins, main water supply is executed to supply water into the drum 6 (wash water) until a target water amount for washing set according to the set washing cycle. The amount of water is preferably big enough that the laundry is in contact to the water. A first level of water inside the drum is reached and it is measured. However, this first water level is lowered as laundry absorbs water in the drum 6. If after a pre-determined time interval, the laundry has absorbed so much water that the difference between the new—second—water level at the end of the predetermined time interval and the first water level is above a given value considered as a threshold, water supply to additionally supply water is executed accordingly. The water is not supplied any more if after the pre-determined time interval the difference between the first level and the second level water is below the selected threshold. The water amount which is introduced in the laundry at the beginning preferably depends on the set washing program or cycle.

After the introduction of the water loading in 7F, the washing and/or rinsing process can proceed in step 8F. The first duration displayed in the display slowly changes as the washing process proceed, the remaining time till the end of the cycle is continuously updated in a countdown manner.

If the first weight is above the first threshold T1, then a "heavy load" is present inside the drum and a more accurate evaluation of the weight of the laundry is performed by means of the second weight sensor 16 is step 9F. To perform this calculation, a pre-defined amount of water is preferably introduced into the drum 6. The water level is lowered as laundry absorbs water. If after a pre-determined time interval, the laundry has absorbed so much water that the difference between a first water level at the beginning of the predetermined time interval and a second water level at the end of the predetermined time interval is above a given value considered as a threshold, water supply to additionally supply water is executed accordingly. The water is not supplied any more if after the pre-determined time interval the difference between the first and second level is below the threshold.

Since weight of laundry is proportional to an amount of absorbing water from laundry, the weight of laundry may be determined according to the number of water resupplies, in each of which a known amount of water is introduced in the drum. That is, since the number of water resupplies varies according to weight of laundry, the second weight of the laundry can be calculated in a more precise manner. Alternatively, not only the number of water resupplies is used to calculate the load of the laundry, but also the time the water takes to maintain the desired water level.

The duration is then recalculated, obtaining the second duration of the washing cycle based on the second weight value. The second duration is preferably totally independent from the previously obtained first duration based on the first weight. This recalculation may result in a second duration which is equal to the first duration or which may differ from the first duration. In case it is different, then also the display is updated with the new value of the duration, that is, it is updated showing the second duration value, which is optimized for washing cycles in which there is a heavy load. The visualized value thus may perform a non-continuous "jump" from the previously displayed first duration value obtained on the basis of the first weight to the new second duration value obtained on the basis of the second weight. This takes place in step 10F. After the second weigh calculation and the determination of the second duration, the washing and rinsing of the laundry takes place in step 11F. a countdown of the second duration display in the display takes place too.

The value of the same parameter which has been determined using the first and the second weight may also be modified by other information regarding the washing cycle or the operative condition of the washing machine 1, or by the "wished value" inputted by the user.

The invention thus conceived can be subjected to numerous modifications and variants all falling within the scope of the inventive concept. In addition, all details can be replaced by other technically equivalent elements. In practice, the disclosed method, as well as the components of the washing machine may vary depending on the requirements without departing from the scope of protection of the following claims.

The invention claimed is:

1. A method to control a washing machine, the washing machine including a tub and a drum, the drum being rotatably mounted inside the tub and configured to contain laundry to be washed, the method comprising:

setting a washing cycle among a plurality of washing cycles;

calculating a first weight of laundry in the drum before water is supplied to the drum and/or tub;

comparing the first weight to a first threshold;

calculating a first duration of the set washing cycle on the basis of the first weight;

displaying the first duration;

(a) upon determining that the first weight is above the first threshold:

introducing water into the tub, calculating a second weight of the laundry present into the drum, calculating a second duration of the set washing cycle on the basis of the second weight, and displaying the second duration in place of the first duration; and (b) upon determining that the first weight is below or equal to the first threshold:

gradually updating the first duration while executing the set washing cycle.

2. The method according to claim 1, further comprising gradually updating the second duration while executing the set washing cycle after displaying the second duration.

3. The method according to claim 1, wherein calculating the second duration of the set washing cycle on the basis of the second weight includes:

calculating the second duration of the set washing cycle on the basis of the second weight, independently from the calculation of the first weight.

4. The method according to claim 1, further including, after setting the washing cycle:

displaying a predefined set washing cycle duration based on stored information on the set washing cycle; and replacing the predefined set washing cycle duration by the displaying of the first duration.

5. The method according claim 1, wherein gradually updating the first duration comprises:

decrementing a value of the first duration in a countdown manner; and displaying the countdown on a display.

6. The method according to claim 2, wherein gradually updating the second duration comprises:

decrementing a value of the second cycle duration in a countdown manner; and displaying the countdown on a display.

7. The method according to claim 1, further comprising:

determining an amount of water to be loaded into the drum during the set washing cycle based on the first weight or based on the second weight.

8. The method according to claim 1, further comprising, upon determining that the first weight is below or equal to the first threshold:

introducing in the drum a predetermined amount of water;

waiting a predetermined time interval after introducing the predetermined amount of water; and preventing additional water introduction in the drum if after the predetermined time interval a water level variation within the predetermined interval is below or equal to a second threshold.

9. The method according to claim 1, further comprising, upon determining that the first weight is above the first threshold:

checking a level of water inside the drum;

calculating the second weight of the laundry present into the drum based on the amount of water needed to maintain the level of water in the drum.

10. The method according to claim 9, further comprising, upon determining that the first weight is above the first threshold:

preventing additional water introduction in the tub if after a predetermined time interval after introducing the water in the tub, a water level variation within the predetermined interval is below or equal to a third threshold;

calculating the second weight of the laundry present into the drum based on the amount of water added in the drum up to the preventing of additional water introduction.

11. The method according to claim 1, wherein the washing machine includes a motor driving the drum in rotation and calculating the first weight of the laundry in the drum before water is supplied to the drum and/or tub comprises:

calculating the first weight by detecting one or more parameters of the motor while the drum is rotating.

12. The method according to claim 1, wherein calculating the first weight of the laundry in the drum before water is supplied to the drum and/or tub comprises:

sensing a plurality of parameters concerning operating conditions of the washing machine; and calculating the first weight of the laundry present within the washing machine based on the plurality of parameters by means of a data-driven soft sensor.

13. The method according to claim 1, further comprising one or more of:

determining the first or second duration also on the basis of a characteristic of the set washing cycle;

determining the first or second duration also on the basis of a hardness of water to be introduced in the tub in the washing;

determining the first or second duration also based on an amount of dirt present in the laundry;

determining the first or second duration also based on a colour of the laundry; and determining the first or second duration also based on a fabric type of the laundry.

14. The method according to claim 1, further comprising:

inputting a preferred duration of the set washing cycle; and determining the first duration or the second furation of the set washing cycle based on the preferred inputted duration.

15. A washing machine comprising:

a tub;

a drum, the drum being rotatably mounted inside the tub and configured to contain laundry to be washed;

a water inlet configured to introduce water into the tub and/or the drum;

a first weigh sensor configured to calculate a first weight of the laundry;

a second weight sensor configured to calculate a second weight of the laundry;

a control panel;

a memory storing information about one or more washing cycles;

a processor configured to:

receive information about a set washing cycle;

obtain a value of the first weight of the laundry from the first sensor before water is supplied to the drum and/or tub through the water inlet;

calculate a first duration of the set washing cycle on the basis of the first weight;

display the first duration;

compare the first weight to a first threshold;

upon determining that the first weight is above the first threshold:

obtain the second weight of the laundry present into the drum from the second sensor after water has been introduced into the drum, calculate a second duration of the set washing cycle on the basis of the second weight, and display the second duration in place of the first duration; and upon determining that the first weight is below or equal to the first threshold:

gradually update the first duration while executing the set washing cycle.

* * * * *